US006934980B2

(12) United States Patent
Harney

(10) Patent No.: US 6,934,980 B2
(45) Date of Patent: Aug. 30, 2005

(54) PATIENT TRANSFER SYSTEM

(75) Inventor: Kathleen Harney, Mansfield, MA (US)

(73) Assignee: The General Hospital Corporation, Boston, MA (US)

( * ) Notice: Subject to any disclaimer, the term of this patent is extended or adjusted under 35 U.S.C. 154(b) by 6 days.

(21) Appl. No.: 10/681,385

(22) Filed: Oct. 7, 2003

(65) Prior Publication Data

US 2004/0128758 A1 Jul. 8, 2004

Related U.S. Application Data

(60) Provisional application No. 60/416,618, filed on Oct. 7, 2002.

(51) Int. Cl.[7] ..... A61G 7/10

(52) U.S. Cl. ..... 5/81.1 R; 5/81.1 HS; 5/85.1; 5/86.1

(58) Field of Search ..... 5/81.1 R, 83.1, 5/85.1, 86.1, 87.1, 81.1 HS, 84.1, 662; 297/DIG. 4

(56) References Cited

U.S. PATENT DOCUMENTS 1,635,575 A * 7/1927 Cole ..... 5/81.1 HS
4,155,588 A * 5/1979 Danziger et al. ..... 297/115
4,949,408 A * 8/1990 Trkla ..... 5/86.1
5,067,188 A * 11/1991 Brantman ..... 5/81.1 HS
5,301,964 A * 4/1994 Papac ..... 280/250.1
5,301,975 A * 4/1994 Rivera ..... 280/304.1
5,735,002 A * 4/1998 Kistner ..... 5/81.1 HS
5,947,501 A * 9/1999 Osborn ..... 280/304.1
6,539,569 B2 4/2003 O'Connell
2003/0140414 A1 7/2003 Wake

* cited by examiner

*Primary Examiner*—Michael Trettel
(74) *Attorney, Agent, or Firm*—Nutter, McClennen & Fish, LLP

(57) ABSTRACT

A system to facilitate the transfer of a patient between a chair and a bed or other device. The system includes a chair and a transfer bridge interchangeably securable to either side of the chair. The top surface of the transfer bridge is positioned at substantially the same height as the seat to allow a patient to slide across the transfer bridge between the chair and bed. The system may also include an overhead canopy to provide patient support and to provide a surface to which various medical apparatus can be attached. The seat of the chair may also provide access to a bedpan positioned therein.

25 Claims, 7 Drawing Sheets

PATIENT TRANSFER SYSTEM

This application claims priority from U.S. Provisional Application No. 60/416,618, filed on Oct. 7, 2002.

BACKGROUND OF THE INVENTION

The invention relates to systems for transferring a patient, and more particularly, to transferring a patient between a chair and a bed with a reduced need for caregiver assistance.

A bedridden patient must often be transferred to and from bed for medical tests, therapy, bathroom visits, and the like. Such transfer is difficult, however, and can pose serious risks to the patient.

Accordingly, a number of devices are known for assisting a patient during these transfers. For example, certain wheelchairs have elevating components that increase transfer accessibility, and some stretcher designs provide for supine transfer of a patient by two caregivers. Transfers can also be facilitated using other devices that convert between bed and chair positions. Separate slide boards are sometimes used to assist in sliding transfer procedures by providing a bridge between two surfaces.

One disadvantage of known patient transfer devices is that they require that at least one caregiver, and usually more than one caregiver, assist the patient during transfer. Such a dependence on medical or caregiver staff has many disadvantages. Dependence on more than one staff member reduces staff efficiency and has the potential to detract staff members from other important tasks. There is also the possibility that a staff member will be injured while lifting or attempting to transfer a patient, leading to future staff shortages. Sometimes overlooked is the further problem that undue attention by the caregiver staff can embarrass a patient.

There is thus a need for a reliable patient transfer system that enables patients to transfer easily between a bed and a chair.

SUMMARY OF THE INVENTION

The present invention provides a system for transferring a patient between a chair and another patient care apparatus, such as a bed. The system includes a chair having side portions, a support seat with a top surface, and a back support. Attached to a side portion of the chair is a transfer bridge having a support surface positioned at substantially the same height as the top surface of the seat. Thus, when the system is placed next to a bed, a patient can slide across the transfer bridge between the bed and the chair. In an exemplary embodiment, the transfer bridge can be removably secured to either side of the chair; such a reversible system allows placement against either side of the bed for patient transfer.

In another aspect of the invention, the support seat is positioned above a support base, and the transfer bridge is removably secured to a side of the support base. The support base can include upper and lower portions that are adjustably coupled to each other to facilitate vertical adjustment of the support seat. The support base may also include an internal cavity for housing a toilet.

In another embodiment, the patient transfer system further includes a canopy that extends above the chair to support the weight of a patient during transfer. The canopy can also provide a surface upon which various types of medical equipment can mount. In one aspect, the canopy includes telescoping components that are selectively extendible to adjust the height of the canopy above the chair. The canopy can also have a slide bar through which the canopy is slidably mounted and is moveable in a horizontal direction, back-and-forth to either side of the slide bar.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention provides a patient transfer system 10 that facilitates the transfer of a patient between a chair and an adjacent patient care apparatus (e.g., a bed). The system 10 is useful in that it facilitates convenient transfer of a patient from one location (e.g., a chair) to another location (e.g., a bed) with relative ease. For most patients, the system 10 allows the transfer to be effected by the patient alone or with the assistance of only one health care specialist.

Figure 1B:
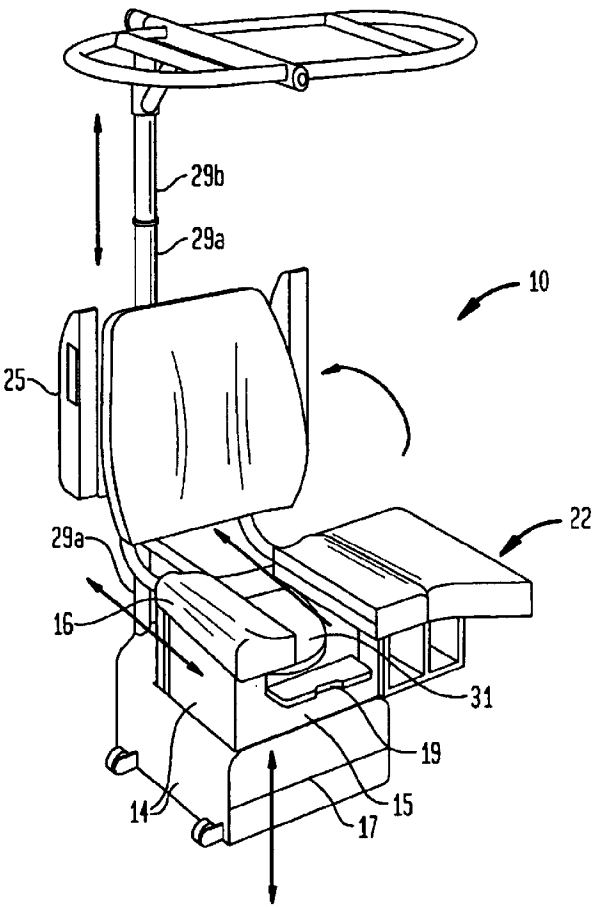
FIG. 1B illustrates adjustable features in the patient transfer system of FIG. 1A.
Figure 1A:
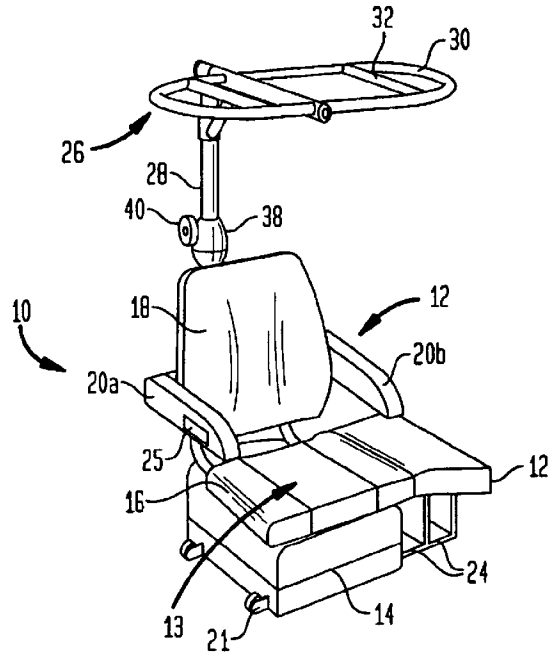
FIG. 1A is a perspective view of a patient transfer system of the according to one embodiment of the invention.

As shown in FIG. 1A, the system 10 includes a specialized medical chair 12 that has a support base 14, a horizontally oriented support seat 16, a vertically oriented back support 18, and armrests 20*a*, 20*b*. Removably secured to one side of the chair 12 is a transfer bridge 22. As described below, the transfer bridge 22 can be attached to either side of the chair 12. The system 10 can also include a canopy 26 having a vertical support 28 and a horizontal support 30. In another embodiment (not shown) the transfer bridge can be attached to another patient care apparatus such as a bed.

Referring to FIG. 1B, the support base 14 has an upper portion 15 and a lower portion 17 that are adjustably coupled to each other to facilitate vertical adjustment. The extent of vertical adjustment can be over any useful range (e.g., from about 10 to 36 inches or more). In a preferred embodiment, the support base 14 includes an internal cavity which is able to house a toilet, such as bedpan 31. The support base also preferably includes access to the internal cavity for cleaning and changing of the bedpan. In one embodiment, the support base 14 can include an access panel 19 that permits access to the bedpan 31, for example the access panel 19 can be pivotally coupled to the front, upper portion 15 of the support base 14. One skilled in the art will appreciate that the support base 14 can be configured in a variety of ways to hold bedpan(s) 31 (or other types of toilets, including portable toilets) and to provide access to the bedpan.

The illustrated support base 14 can further includes wheels 21, which preferably are secured to a lower portion of the support base 14, but which can be secured to any portion of the chair 12 that permits the wheels 21 to selectively contact the floor. In one embodiment, shown in FIGS. 1A and 1B, the wheels 21 do not contact the floor when the chair is in a normal, operative orientation (e.g., in use by a patient). In this embodiment, the wheels 21 only contact the floor when the chair is in an inoperative mode, such as when the chair is tilted. One skilled in the art will readily appreciate that the system may also be configured to have the wheels 21 in contact with the floor when the chair is in an operative mode. In such an embodiment, a locking mechanism should be provided to prevent unintended movement of the chair 12.

With continued reference to FIG. 1B, the support seat 16 is adjustably coupled to the support base 14, and is capable of horizontal, forward-rearward adjustment. Such horizontal adjustment can accommodate standard or bariatric sizes and can vary depending on a variety of factors such as patient size and mobility. In one embodiment, the support seat can have a horizontal adjustment in the range of about 2 to 8 inches. To enhance patient comfort, the patient-contacting surface of the support seat 16 may include contoured cushions having pressure relief features. As shown in FIG. 1A, the support seat 16 preferably includes a panel 13 above the internal cavity for patient access and use of the bedpan 31. By way of example, the removable panel 13 can be slidably coupled (i.e., by a track and groove) between opposed side portions of the support seat 16. Thus, except during bedpan 31 use, the removable panel 13 preferably closes access through the support seat to the internal cavity of the support base 14. Other configurations for accessing and using the bedpan 31 will be apparent to those skilled in the art.

The back support 18 can be adjustably coupled to the chair 12 so as to allow adjustment in the vertical direction, or other adjustment, such as angular adjustment (i.e., reclining). Such adjustment can preferably be as much as 6 inches or more in the vertical direction and preferably be up to 90 degrees or more in an angular direction. The back support 18 can include a contoured cushion to enhance patient comfort.

As shown in FIGS. 1A and 1B, the armrests 20*a,* 20*b* are pivotally attached to the sides of the back support 18 and are movable between horizontal and vertical positions. The armrests can include contoured cushions, as described above, for enhanced patient comfort. Armrest 20*a* may include powered controls 25 that adjust any moveable feature of the chair 12 as described above or below (e.g., support base 14 height and support seat 16 depth). It is understood, however, that the controls 25 may be positioned elsewhere in the system 10.

The chair 12 can further include leg rests (not shown) to provide added comfort and convenience to a patient. The leg rests can attach to front or side portions of the support base 14, or to any other portion of the chair 12. In a preferred embodiment, the leg rests can adjust between multiple positions. For example, the leg rests can adjust to support the legs of a patient in different orientations. When not being used, the leg rests can adjust to a non-restrictive position away from the patient. Various mechanisms for the adjustable leg rests will be apparent to those skilled in the art.

As illustrated in FIGS. 2A through 2D, transfer bridge 22 is attached to the upper portion 15 of the support base 14. However, one skilled in the art will appreciate that the transfer bridge 22 can otherwise attach to any other side portion of the support base 14, or to another portion of the chair 12. Regardless of where the transfer bridge is attached, the top surface of the transfer bridge is preferably at substantially the same height as the support seat 16. In one embodiment, the transfer bridge 22 is constructed of more than one piece and can include a bridge support 23, upon which is mounted a patient support member 36.

The patient supporting member 36 of the transfer bridge 22 may be contoured to facilitate patient transfers. In one embodiment, illustrated in FIG. 2D, the sidewalls of the patient supporting member 36 have dissimilar lengths such that the side of the patient supporting member adjacent to the chair 12 is shorter than the opposite end of the patient supporting member. The longer side produces a flared, protruding front portion and a patient-supporting surface that is larger on the side adjacent to a healthcare apparatus as shown in FIG. 3. In another aspect, the sidewalls of the patient supporting member 36 can increase or decrease in height between the patient supporting member ends. Thus, the patient supporting member can have a patient-supporting surface that ramps up or down toward an adjacent healthcare apparatus.

The top surface of the patient supporting member preferably acts as the support surface across which a patient can transfer. To assist transfer, the patient supporting member can be suited to the needs of a patient. In one embodiment, the patient supporting member is cushioned for patient comfort. In other cases, it may be preferable to use a rigid patient supporting member. The top surface of the patient supporting member can also be constructed of low or reduced friction materials to facilitate patient transfer.

In another embodiment, the transfer bridge 22 can be constructed from one piece, and it can preferably have any or all of the features of the patient transfer system discussed above (e.g. longer side, ramped, etc.).

Figure 2D:
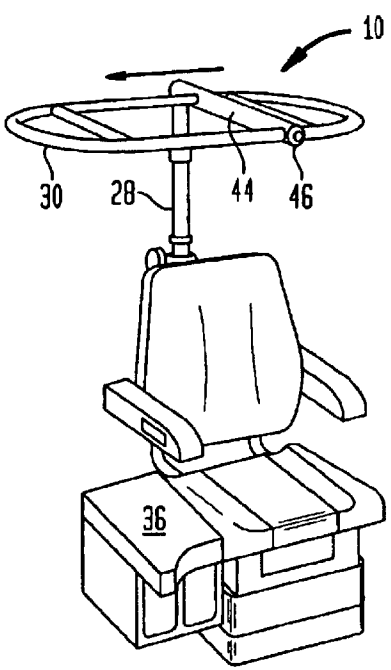
FIGS. 2A through 2D illustrate another embodiment of the present invention.
Figure 2C:
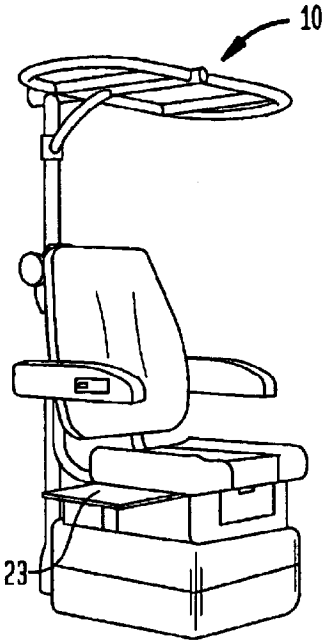
Figure 2B:
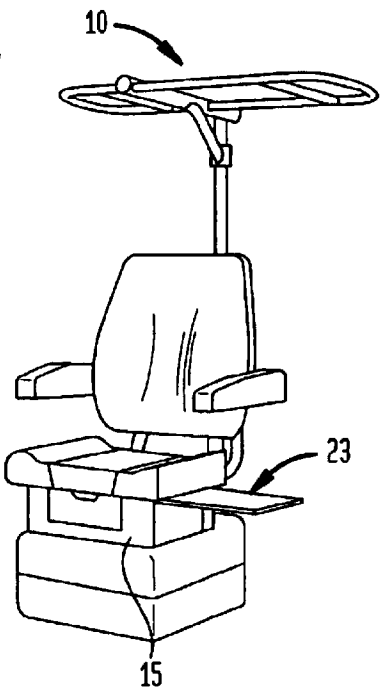
Figure 2A:
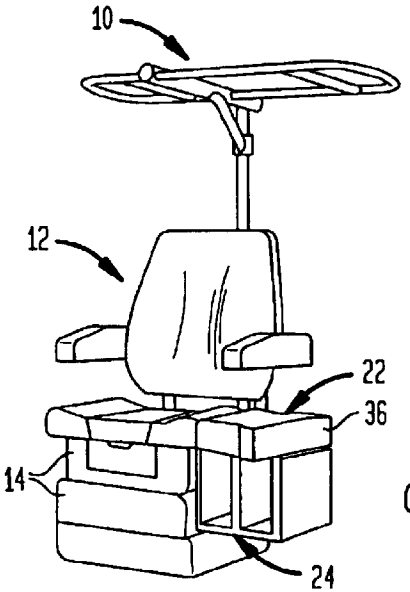
Figure 3:
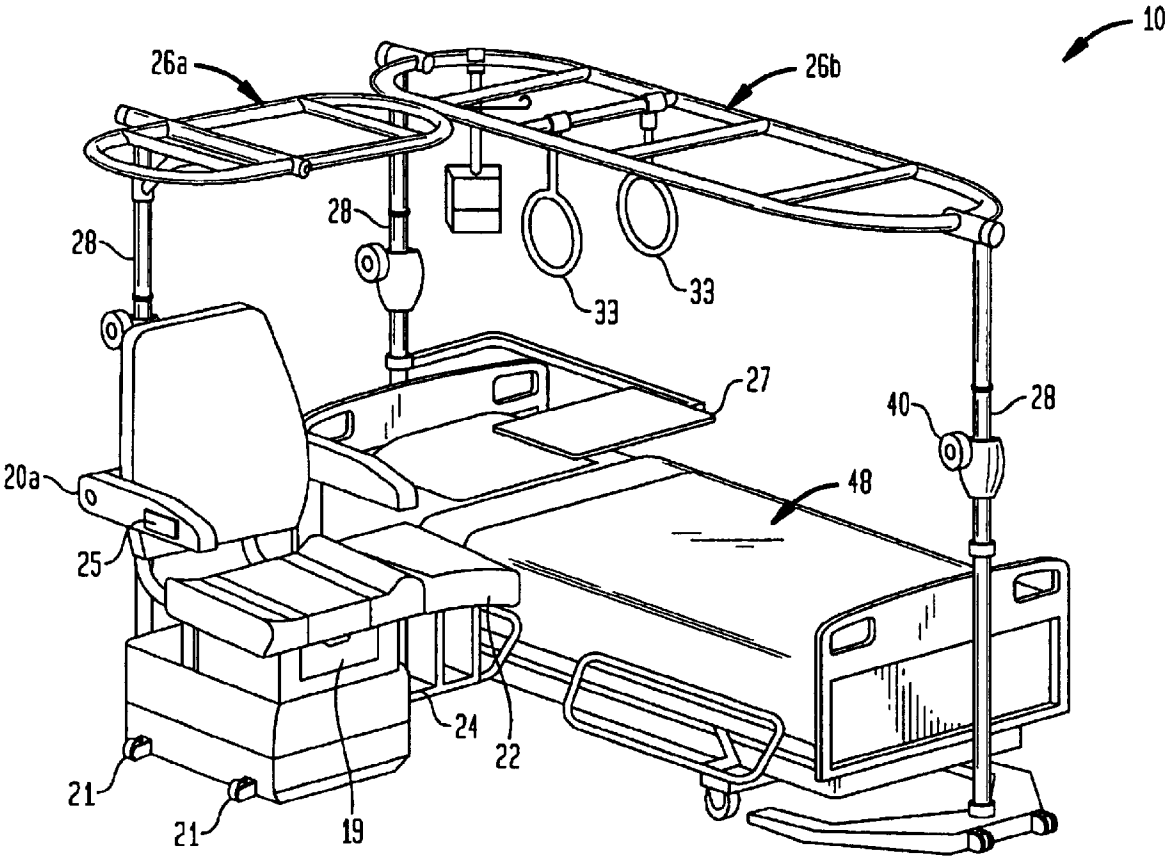
FIG. 3 illustrates another embodiment of the present invention shown in perspective.

With continued reference to FIGS. 2A–2D, the transfer bridge 22 may have mounted to a bottom portion thereof one or more storage shelves 24. Rather than shelves 24, which have open access, likewise mounted to the transfer bridge 22 may be storage compartments. The storage compartments can have one or more doors that provide selective access to each compartment. A locking mechanism may selectively lock the doors in a closed position. FIGS. 2A through 2D further illustrate that the transfer bridge 22 can be removably attached to either the left or right sides of chair 12. FIG. 2A illustrates the bridge support 23, with storage shelves 24, attached to the left side of chair 12. In FIG. 2B, the patient supporting member and storage shelves have been removed from the left side of the chair 12, leaving only bridge support 23 attached to the left side of the chair 12. In FIG. 2C, the bridge support 23 is attached to the right side of the chair 12, and in FIG. 2D, both the patient supporting member and storage shelves 24 are likewise attached to the right side of the chair 12.

Referring to FIGS. 1A and 1B, a canopy 26 includes a vertical support 28 that extends upward adjacent to the back support 18. The vertical support 28 can otherwise extend along any side of the chair 12. In one embodiment, at least a portion of the vertical support 28 is attached to a portion of the chair 12. As shown in FIG. 1B, the vertical support 28 preferably includes two telescoping components 29*a,* 29*b* that permit the vertical support 28 to be selectively extendible to enable adjustment of canopy height. The telescoping components 29*a,* 29*b* can be manually adjusted using a canopy jack 38 and handwheel 40 combination that has a force-multiplying mechanism (e.g., a geared machine screw). Those skilled in the art will appreciate that alternative mechanisms, including powered mechanisms, can also be used to adjust the height of the canopy 26.

The vertical support 28 can attach to the chair 12 (e.g., a rear portion thereof) or, it can be free standing with a base support 34 (see FIG. 3). A vertical support 28 that is free standing preferably has wheels 21 secured to its base support 34, and the wheels preferably have operative and inoperative modes that prevent unintended movement of the vertical support 28.

Figure 4B:
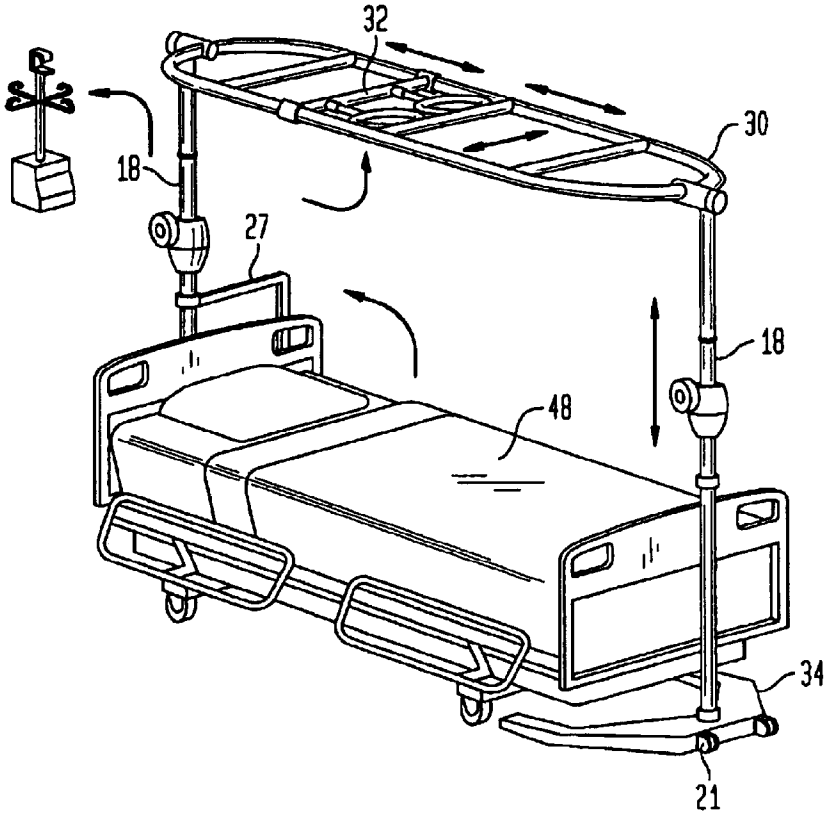
FIGS. 4A and 4B illustrate an exemplary bed of the present invention.
Figure 4A:
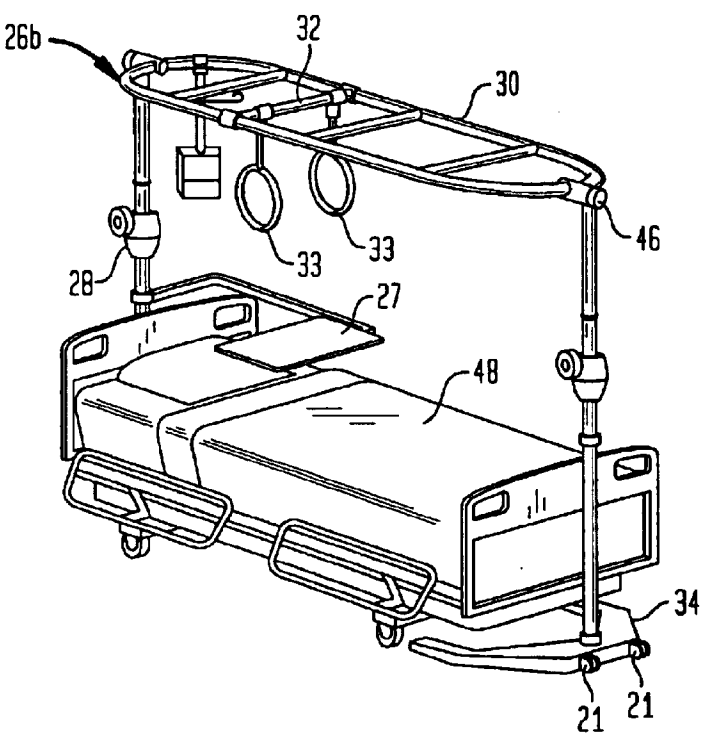

The vertical support 28 can also include a tray table 27 as shown in FIG. 3 to provide a patient with added convenience. The tray table 27 can attach to the vertical support 28 by an adjustable arm having different positions during use and nonuse of the tray table 27. In one embodiment, to accommodate use of the tray table 27, the arm can adjust to locate the tray table 27 in front of a patient, as shown in FIG. 4A. The arm can otherwise be adjusted to position the tray table 27 away from the patient when not in use as shown in FIG. 4B. Various mechanisms for the adjustable arm will be apparent to those skilled in the art.

As illustrated in FIGS. 1A through 2D, the canopy includes a horizontally oriented canopy support 30 that is generally oval-shaped. However, one skilled in the art will appreciate that the canopy support 30 can have a variety of shapes that allow it to support all or part of a patient's weight and to hold a variety of medical equipment (e.g., supplies, drug delivery devices, etc.).

The canopy support 30 may include one or more cross bars 32, which provide support and stability to the canopy and also provide a surface upon which other accessories can be mounted. FIG. 3, for example, illustrates that mobility rings 33, which can be used for patient support, are attached to cross bars 32. The mobility rings 33 can attach to the cross bars, or to any other portion of the canopy support 30, by a flexible attachment member (e.g., a chain) or a rigid attachment member. Mobility rings 33 having rigid attachment members can pivotally attach to the canopy support 30 and can have different positions for added convenience. FIG. 4A illustrates mobility rings 33 that, during normal use, hang in a vertical position to provide patient support. When not in use, as shown in FIG. 4B, the mobility rings 33 can pivot out of the way in a horizontal position. A locking mechanism, such as a quick release lever, can selectively lock the rings 33 in the horizontal position.

Figures 5A, 5B, 5C:
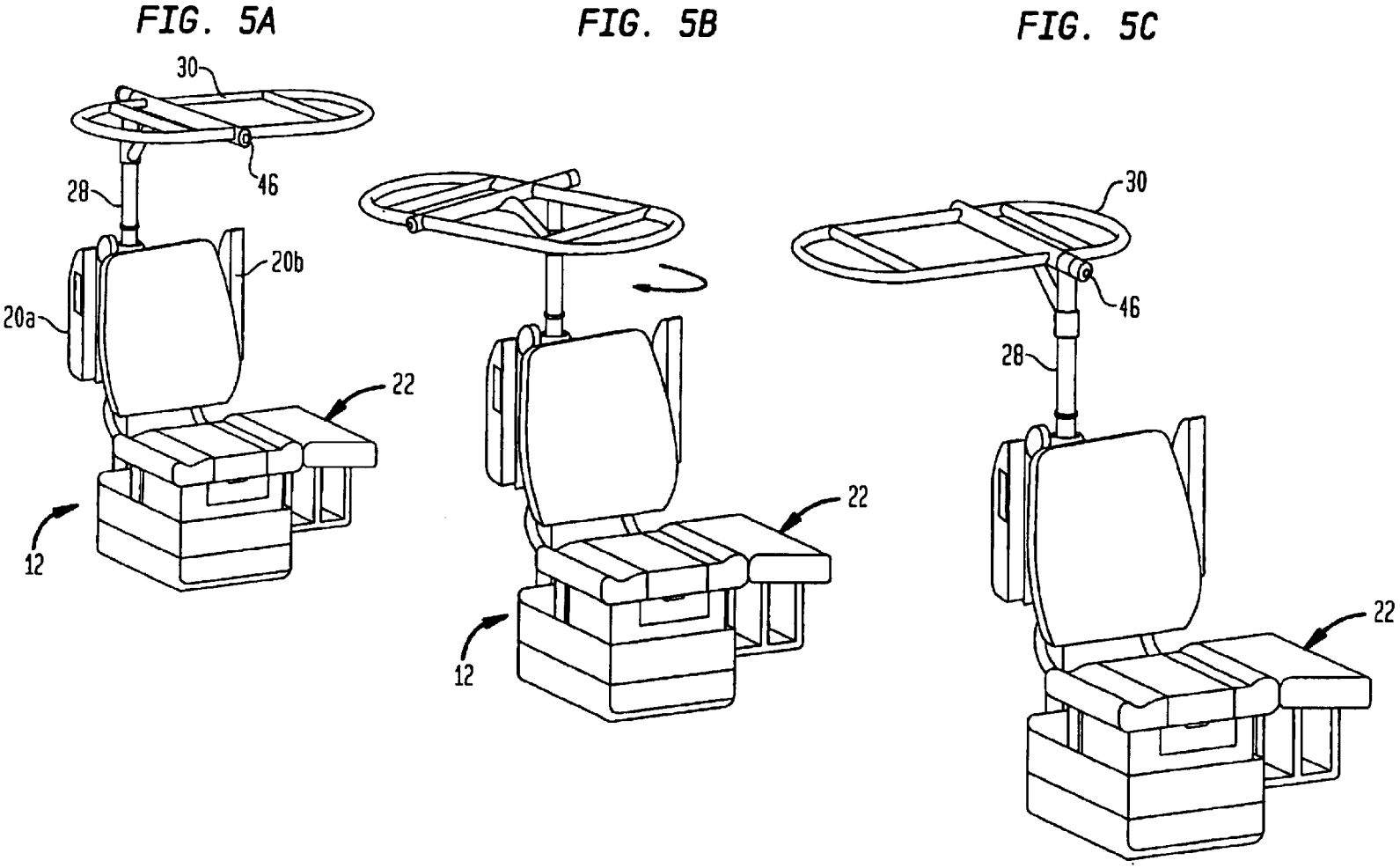
FIGS. 5A through 5C illustrate another embodiment of the present invention shown in perspective.

Referring to FIGS. 5A–5C, the canopy support 30 is removably coupled to the vertical support 28 to enhance access to the chair 12 and to facilitate convenient transport. Preferably, the canopy support 30 is also pivotally coupled to the vertical support 28, to allow the canopy support to pivot in a horizontal plane for proper positioning. A locking mechanism, such as a quick release lever 46, can be used to lock the canopy in a desired position. For example, the canopy support can be locked above the chair during normal use and be locked behind the chair when enhanced access is desired.

Referring to FIG. 2D, the canopy support 30 further includes a slide bar 44 through which the canopy support 30 is slidably mounted to enable the canopy support 30 to slide back-and-forth to either side of the slide bar 44. In a preferred embodiment, the slide bar 44 includes a locking mechanism, such as a quick release lever 46, that selectively locks the canopy support 30 in a desired position.

Although the canopy 26 is illustrated in the FIGS. as above both the chair and the bed, the canopy 26 can be positioned only above the chair 12 to act as a chair canopy 26*a* or only above the bed to act as a bed canopy 26*b*. In either case, the individual chair or bed canopy can have all the features discussed above.

Figure 6A:
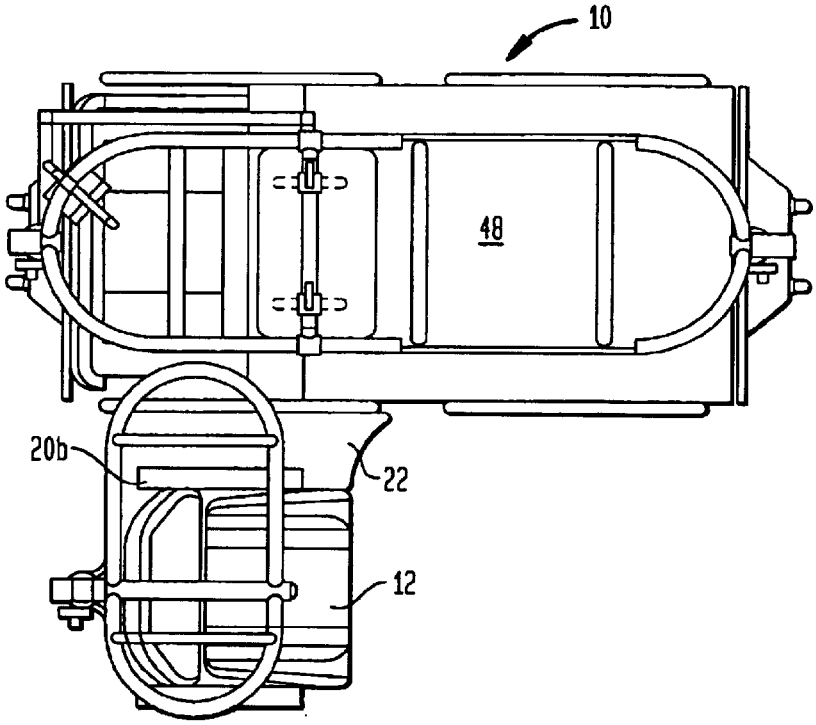
FIGS. 6A through 6C illustrate another embodiment of the present invention shown in a top, side and front view respectfully.
Figure 6B:
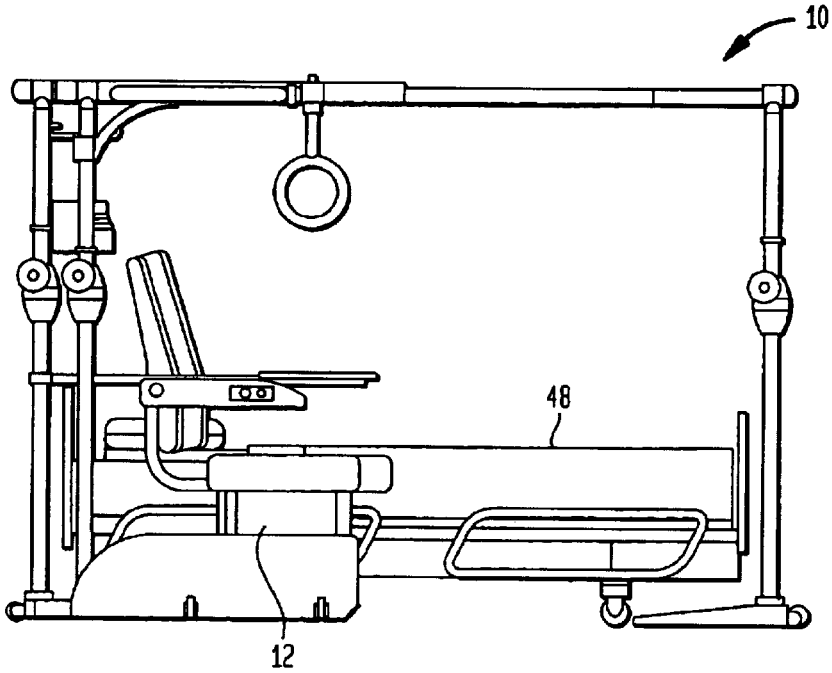
Figure 6C:
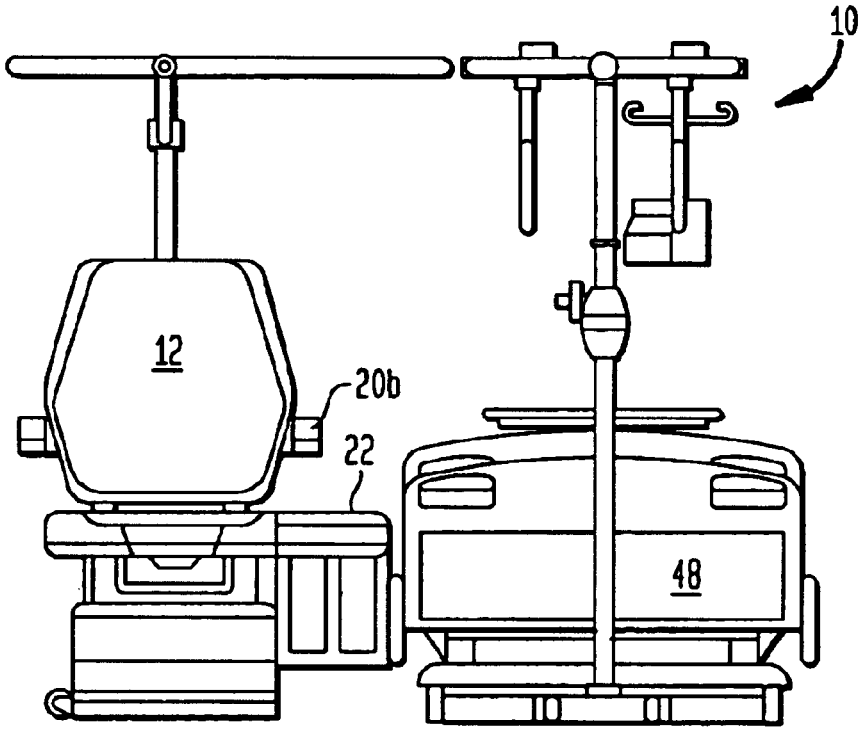

FIGS. 6A–6C illustrate the patient transfer system 10 in use with other patient care systems, including a bed 48 and a peripheral canopy 26*b* that is associated with the bed 48. To effect patient transfer, from the bed 48 to the chair 12 for example, the chair 12 is positioned adjacent to the bed 48 with the transfer bridge 22 positioned closely adjacent to or in contact with the edge of the bed 48. Preferably, any floor-contacting wheels of the chair 12 are in the locked position to prevent inadvertent movement of the chair during patient transfer. The patient (not shown) may position the armrest 20*b* in a vertical position and slide from the bed 48, across the transfer bridge 22 to the chair 12.

One skilled in the art will appreciate further features and advantages of the invention based on the above-described embodiments. Accordingly, the invention is not to be limited by what has been particularly shown and described, except as indicated by the appended claims.

What is claimed is:

1. A patient transfer system, comprising:

a chair having side portions, a support seat with a top surface, and a back support disposed adjacent to a rear portion of the support seat, the chair further comprising at least one wheel that are not able to contact the floor when the chair is in an operative orientation; and a transfer bridge removably secured to the chair, the transfer bridge having a support surface that is adapted to be positioned at a level substantially the same as the top surface of the support seat and being effective to support the weight of a patient during transfer of the patient between the chair and an adjacent patient care apparatus.

2. The system of claim 1, wherein the transfer bridge is removably secured to one of the side portions of the chair.

3. The system of claim 1, wherein the chair includes a support base disposed below the support seat.

4. The system of claim 3, wherein the transfer bridge is removably secured to the support base.

5. The system of claim 1, wherein the transfer bridge includes a bridge support.

6. The system of claim 5, wherein the transfer bridge is removably secured to the chair.

7. The system of claim 6, wherein a patient supporting member is positioned on the transfer bridge and the top surface of the patient supporting member is the support surface.

8. The system of claim 7, wherein the support surface has an end adjacent to the chair that is shorter than an opposed end, so that the support surface is larger toward the end opposite the chair.

9. The system of claim 1, wherein the top surface of the support seat varies in height.

10. The system of claim 9, wherein the level of the top surface of the support seat immediately adjacent to the support surface is the level is used to determine the level of the support surface.

11. The system of claim 1, wherein the chair includes a canopy having a vertical support, a horizontally oriented canopy support, and at least one mobility ring to assist in patient transfer.

12. The system of claim 1, wherein the system includes a bed, and the transfer bridge is positioned adjacent to the bed.

13. A patient transfer system, comprising:

a chair having a support base with opposed side portions, a support seat with a top surface positioned above the support base, and a back support; and a transfer bridge removably secured to the chair, the transfer bridge having a support surface that is positioned at a level substantially the same as the top surface of the support seat and being adapted to support the weight of a patient during transfer of the patient between the chair and an adjacent patient care apparatus, the support surface having an end adjacent to the chair that is shorter than an opposite end, so that the support surface is larger toward the end opposite the chair.

14. The system of claim 13, wherein the transfer bridge is removably secured a side portion of the support base.

15. The system of claim 13, wherein the support base includes a lower portion and an upper portion that are adjustably coupled to each other to facilitate vertical adjustment of the support seat.

16. The system of claim 15, wherein the chair further includes a control circuit electrically coupled to the chair and effective to provide powered control of the adjustable coupling between the lower portion and upper portion of the support base.

17. The system of claim 13, wherein the support base further includes an access panel formed in a portion of the support base and being effective to provide access to an internal cavity of the support base.

18. The system of claim 13, wherein the chair includes a selectively removable panel formed in the support seat above an internal cavity for providing access to a toilet disposed in the internal cavity.

19. The system of claim 13, wherein the support base further includes at least one wheel that is adapted to have selective contact with the floor, such that the wheels contact the floor when the chair is in an inoperative mode and are removed from the floor when the chair is in an operative mode.

20. The system of claim 13, wherein the top surface of the transfer bridge is a cushioned patient-supporting surface.

21. The system of claim 13, wherein the chair includes a canopy having a vertical support, a horizontally oriented canopy support, and at least one mobility ring to assist in patient transfer.

22. The system of claim 13, wherein the system includes a bed, and the transfer bridge is positioned adjacent to the bed.

23. A patient transfer system, comprising:

a chair having side portions, a support seat with a top surface, and a back support disposed adjacent to a rear portion of the support seat; and a transfer bridge removably secured to the chair, the transfer bridge having a support surface that is adapted to be positioned at a level substantially the same as the top surface of the support seat and being effective to support the weight of a patient during transfer of the patient between the chair and an adjacent patient care apparatus, the support surface having an end adjacent to the chair that is shorter than an opposed end, so that the support surface is larger toward the end opposite the chair.

24. The system of claim 23, wherein the top surface of the transfer bridge is a cushioned patient-supporting surface.

25. A patient transfer system, comprising:

a chair having a support base with opposed side portions, a support seat with a top surface positioned above the support base, and a back support; and a transfer bridge removably secured to the chair, the transfer bridge having a support surface that is positioned at a level substantially the same as the top surface of the support seat and being adapted to support the weight of a patient during transfer of the patient between the chair and an adjacent patient care apparatus, wherein the transfer bridge further includes a storage shelf disposed below the patient-contacting surface of the transfer bridge.

* * * * *

UNITED STATES PATENT AND TRADEMARK OFFICE

CERTIFICATE OF CORRECTION

PATENT NO. : 6,934,980 B2
APPLICATION NO. : 10/681385
DATED : August 30, 2005
INVENTOR(S) : Kathleen Harney It is certified that error appears in the above-identified patent and that said Letters Patent is hereby corrected as shown below:

At column 1, line 5, before "BACKGROUND OF THE INVENTION", insert the following:

STATEMENT REGARDING FEDERALLY SPONSORED RESEARCH

This invention was made with Government support under Grant No. DAMD17-02-2-0006 awarded by the U.S. Department of the Army. The U.S. Government has certain rights in this invention.

Signed and Sealed this

Twenty-eighth Day of April, 2009

JOHN DOLL
*Acting Director of the United States Patent and Trademark Office*